United States Patent [19]

Forster et al.

[11] 4,367,575

[45] Jan. 11, 1983

[54] DEVICE FOR SIMULTANEOUS CONNECTION OF A SERIES OF CABLES TO CORRESPONDING CONTACTS

[75] Inventors: Peter Forster, Egelsbach; Werner Heidotting, Muenster, both of Fed. Rep. of Germany; Wilhelm Janosi, Vienna, Austria; Georg Kampfmann, Darmstadt-Eberstadt, Fed. Rep. of Germany

[73] Assignee: AMP Incorporated, Harrisburg, Pa.

[21] Appl. No.: 167,862

[22] Filed: Jul. 14, 1980

[30] Foreign Application Priority Data

Jul. 16, 1979 [DE] Fed. Rep. of Germany ..... 2928704

[51] Int. Cl.[3] ..... H01R 43/04

[52] U.S. Cl. ..... 29/33 M; 29/564.4; 29/564.6; 29/749; 29/785; 29/792

[58] Field of Search ..... 29/785, 564.1, 564.4, 29/564.6, 748, 749, 792, 33 M

[56] References Cited

U.S. PATENT DOCUMENTS

| | | | |
|---|---|---|---|
| 3,583,055 | 6/1971 | Hammond | 29/564.1 |
| 3,939,552 | 2/1976 | Hart et al. | 29/564.2 X |
| 4,043,017 | 8/1977 | Folk et al. | 29/749 |
| 4,055,889 | 11/1977 | Fusco et al. | 29/748 X |
| 4,136,440 | 1/1979 | Brandewie et al. | 29/628 |

*Primary Examiner*—Z. R. Bilinsky

[57] ABSTRACT

A wire holding head (13) reciprocable between a wire supply and a wire terminating station (11) includes a wire guide (62) pivoted on the front of a wire clamp (61) and an abutment (20) carried by a wire insertion ram (14) which moves the guide towards a connector support (15) to align leading ends of wires with contacts in a connector (17). The connector supports (15) are mounted on indexed turrets (19) and wire locating combs (51) are engageable with the wires between a severing and stripping station (12) and the terminating station (11).

5 Claims, 4 Drawing Figures

DEVICE FOR SIMULTANEOUS CONNECTION OF A SERIES OF CABLES TO CORRESPONDING CONTACTS

The invention relates to apparatus for terminating individual wires of a series of wires simultaneously in respective contacts arranged in a row in an electrical connector, particularly for the manufacture of electrical harnesses.

In such apparatus, it is important that high production rates are achieved to minimise production costs and yet that the connections to the individual contacts are reliable. These requirements pose problems in locating the many wires accurately throughout the operational cycle and for termination or testing.

The invention may be regarded as an improvement in the apparatus disclosed in European Patent Application No. 78.300102.7 (8898) which discloses apparatus for terminating individual wires of a series of wires simultaneously in respective contacts arranged in a row in an electrical connector which apparatus comprises a terminating station comprising a connector support and a ram mounted to reciprocate relative to the support to drive wires into wire-receiving parts of respective contacts of the connector when mounted on the support and a wire holding head mounted to reciprocate between the terminating station and a wire supply to feed a series of wires from the supply to a location spaced from and between the connector and the ram, the wire holding head comprising a wire clamp and a wire guide pivotally mounted on the clamp to extend forwardly thereof and having a series of wire-receiving passageways retaining wires when holding the clamp, in predetermined, laterally spaced, parallel, coplanar relation.

In the prior apparatus, lost motion between the wire guide and the clamp during the final stages of movement towards the terminating station causes substantial lengths of wires to project forwards at their leading ends in general alignment with the respective wire-receiving parts of the contacts. However, as the wires are spaced from the respective wire-receiving parts of the contacts, it is necessary to provide guide means, for example, a template defining wire-receiving channels, between the ram and the connector support to guide each wire precisely to the wire connecting portion during engagement by the ram, such precise location being necessary for reliable terminating particularly with very closely spaced contacts having wire-receiving slots.

A disadvantage of the prior apparatus is that the template may cause obstruction at the terminating station and impede the handling of connectors particulaly where automatic connector feed is desired to increase the speed of operation.

According to one aspect of the invention, the wire guide is mounted for pivotal movement relative to the clamp and an abutment is mounted on the ram arranged to engage the wire guide during a terminating stroke to pivot towards the connector support to guide leading ends of the wires to wire connecting parts of respective contacts.

This obviates the need for a separate wire guiding template and enables automatic connector feed techniques more readily to be used.

In a preferred form, the connector support comprises a series of connector holders located on a turret mounted for stepped rotation about an axis parallel to the path of movement of the wire holding head when the wire holding head is remote from the terminating station to bring connectors successively into alignment with the ram.

Rotation of the turret, will not therefore be impeded by the presence of a wire guide enabling rapid connector feed and high production rates.

Viewed from another aspect, apparatus for terminating individual wires of a series of wires simultaneously in respective contacts arranged in a row in an electrical connector including a terminating station and a wire severing and stripping station spaced from the terminating station, the terminating station comprising a connector support and a ram mounted to reciprocate relative to the support to drive wires into wire-receiving parts of respective contacts of a connector when mounted on the support; a wire holding head mounted to reciprocate passed the severing and stripping station between the terminating station and a wire supply on a side of the severing and stripping station remote from the terminating station to feed a series of wires in predetermined, laterally spaced, parallel, coplanar relation to extend through the severing station to the terminating station; a wire support being provided between the severing and stripping station, and the terminating station, which support comprises a wire locating comb, means being provided to move the comb into engagement with the wires to maintain their predetermined spacing after severing.

Accurate location of the severed ends of the wires by the comb enables a further series of testing or terminating steps readily to be carried out without risk of wire tangling.

Preferably a series of connector supports and wire supports are located on respective turrets mounted for synchronous stepped rotation about an axis parallel to the path of movement of the wire holding head after termination and severing.

The turrets convey a set of wires terminated at one end in a connector and with their other ends located by the combs laterally away from the terminating and operating stations, respectively.

The invention includes the provision of the connector supports in rotary turrets in the prior apparatus where both ends of the wires are terminated in connections at the terminating station and at the severing and stripping station, respectively.

A specific example of the invention will now be described with reference to the accompanying drawings in which.

The invention may be regarded as an improvement in the apparatus disclosed in the above-mentioned application to which reference is hereby directed and which apparatus terminates a series of wires at one end by inserting it in a slotted plate connector such as that described in U.S. Pat. No. 3,760,335 and severs and strips the insulation from the other end in preparation for a separate terminating step.

Figure 1:
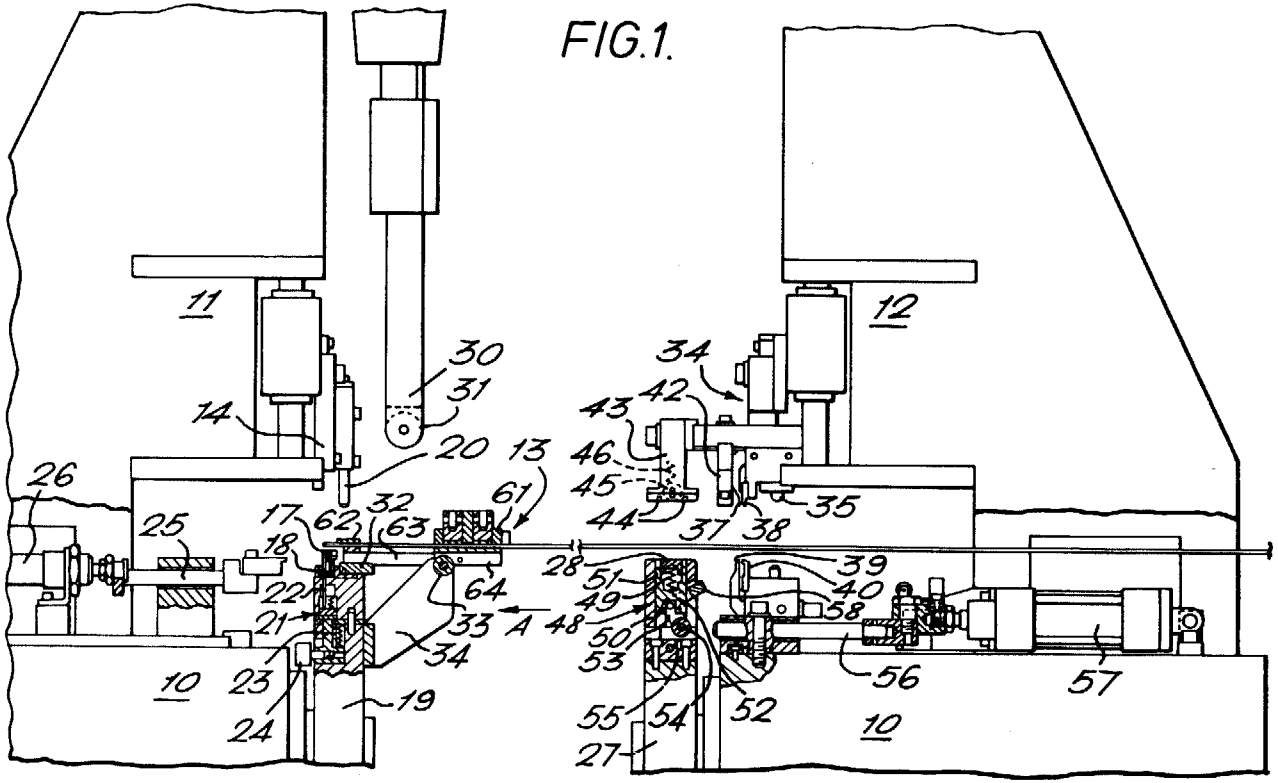
FIG. 1 is a side elevation of the apparatus partly in cross-section immediately prior to termination of the wires.
Figure 2:
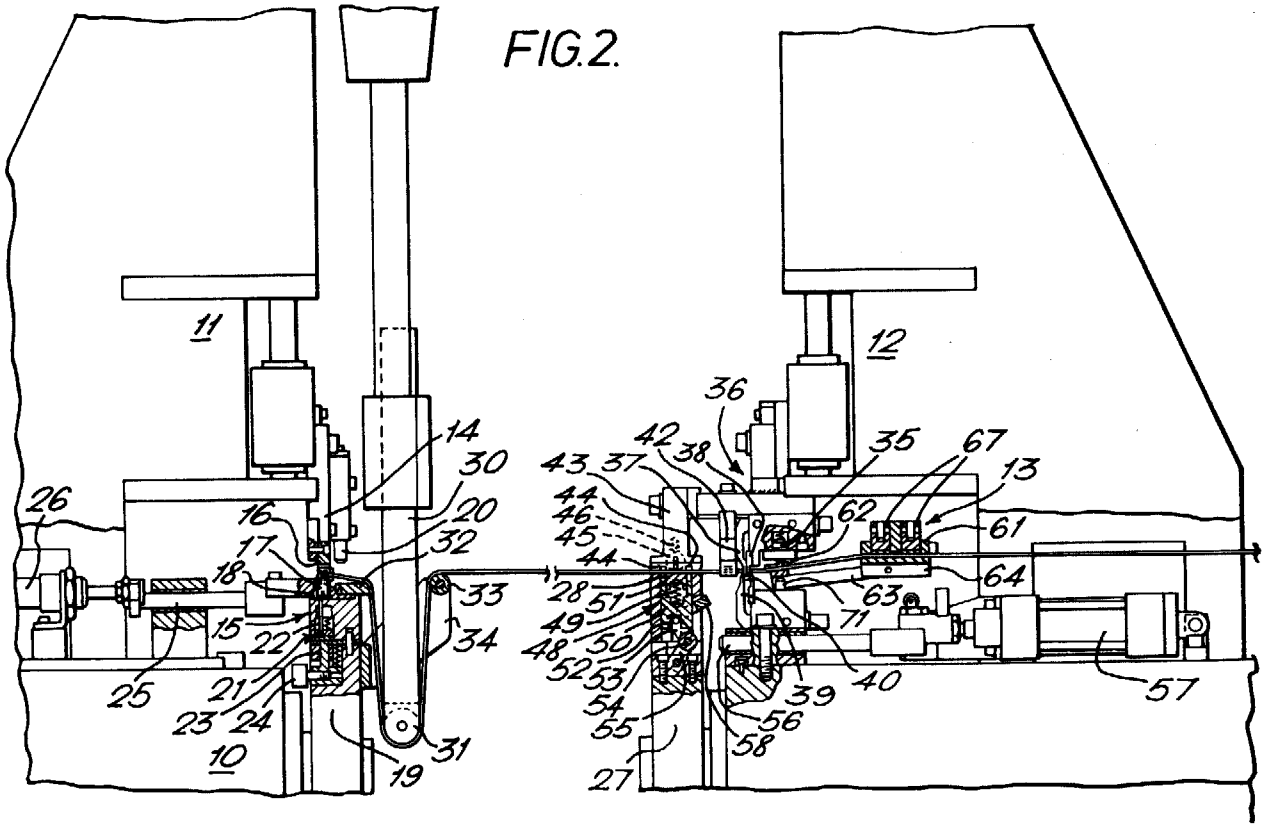
FIG. 2 is a similar view to FIG. 1 after termination with, and immediately prior to, wire severing and stripping.
Figure 3:
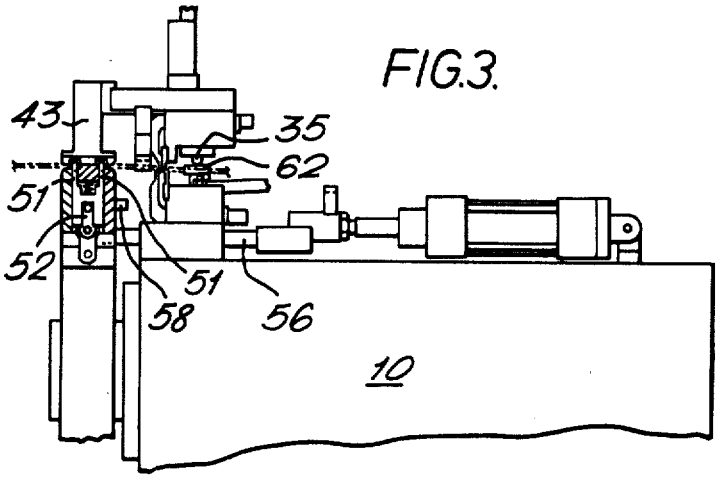
FIG. 3 is a fragmentary view similar to FIG. 2 after operation of a wire locating comb.

As shown particularly in FIGS. 1 to 3, the apparatus comprises a wire terminating first station 11 and a wire stripping second station 12 spaced apart horizontally on a frame 10. A wire holding head (or shuttle) 13 is mounted for horizontal reciprocating movement on the frame to feed wires past the second station from a wire store (not shown) to the first station.

The wire terminating station comprises a ram 14 vertically reciprocable relative to a connector support 15 so that stuffers 16 drive wires into slotted wire-receiving portions of respective contacts arranged in a row in a connector 17. The ram carries an abutment pin 20 for engagement with the head 13 during downward movement.

The connector support 15 includes a series of connector holders 18 located on the periphery of a turret 19 mounted for stepped rotation on a horizontal axis to bring connector holders successively into alignment with the ram. An ejection mechanism 21 is mounted in the turret under each connector holder 18 and comprises one or more ejection pins 22 operatable by a push rod 23 against return springs to advance into the connector holder to engage and eject the connector from the holder. The push rod 23 is connected to a cam follower 24 engageable with an ejection cam (not shown) mounted on the frame after rotation of the turret past the termination and a test stage.

A steadying arm 25 is mounted on the frame for horizontal reciprocating movement by a piston and cylinder 26 to engage and steady the connector holder during termination.

A wire lengthening arm 30 having a roller 31 at a leading end is mounted immediately in front of the ram for vertical movement into a slot bounded by a transverse member 32 of each connector holder and a roller 33 supported by plates 34 attached to the turret to extend transversely of the path of movement of the wire holding head and to the wires. Movement of the arm 30 is effected by first and second piston and cylinder devices for wire lengthening and wire stripping operations, respectively, as explained below, enabling separate adjustment of the wire feed length and stripping length readily to be made.

The wire severing and stripping station 13 comprises a vertically reciprocating head assembly 36 carrying upper wire stripping and severing blades 37 and 38 respectively, for engagement with lower stripping and severing blades 39 and 40 mounted on the frame when the head assembly is at its limit of downward travel. Immediately behind the severing blade 38, is mounted a spring biased abutment pin 35 arranged to move downwardly with the head assembly to engage and depress a front guide on the wire holding head, as explained below. Immediately in front of the stripping blade is mounted a vertically extending wire guiding arm 42.

A vertically extending wire locating arm 43 is mounted at the front of the head assembly and a lower end of the arm is formed with a pair of downwardly facing, spaced parallel channels 44, which extend transversely of the path of movement of the wire holding head 13. A wire-engaging roller 45 is transversely mounted between the channels 44 for limited vertical movement against the action of a biasing spring 46.

A series of wire supports 48 are mounted on the periphery of a turret 27 mounted on the frame for stepped rotation about a horizontal axis in synchronism with the turret 19. Each wire support includes a wire engaging bar 28 supported directly below the roller on a compression spring 49 seated in the base of a channel section wire guide 50, the side walls of which are slotted to provide a pair of parallel, transverse wire-receiving combs 51. The wire guide 50 is mounted for vertical reciprocating movement on the elbow of a bell crank lever 52 having one arm 53 pivoted to one end of a link 55 pivoted at its other end to the turret so that the arm 53 with the link constitute an overcentre mechanism. The linkage is moved overcentre to raise the combs by the engagement of the pivot 54 with an operating rod 56 mounted for horizontal reciprocation by a piston and cylinder device 57. The other arm 58 of the bell crank acts as a trip lever for engagement with an abutment of the frame during rotation of the turret to restore the mechanism to its original state.

The wire holding head 13 comprises a rear wire clamping part 61 and a front wire guide 62 carried by arms 63 pivoted on opposite lateral sides of a base 64 of the clamping part 61. The wire guide defines a series of wire-receiving passageways retaining the leading ends of the wires laterally spaced in parallel, coplanar, relation. The clamping part 61 has a body also defining a series of wire-receiving passageways and a pair of wire clamping arms 67 are hinged to a lateral side of the body and retained in a wire clamping condition by a spring biased catch 65 pivoted to the opposite lateral side of the body. It should be noted that the catch is releasable by a roller 66 carried at the end of an abutment on the terminating ram engaging a cam surface of the catch during downward movement of the ram and compression spring 69 biases the clamping arms in an open condition in which the wire holding head can move freely along the wires.

The body of the wire holding head is mounted for reciprocation on rails 68 which extend between the stations and reciprocated by a 'flying' or 'rod-less' piston and cylinder device (not shown).

Figure 4:
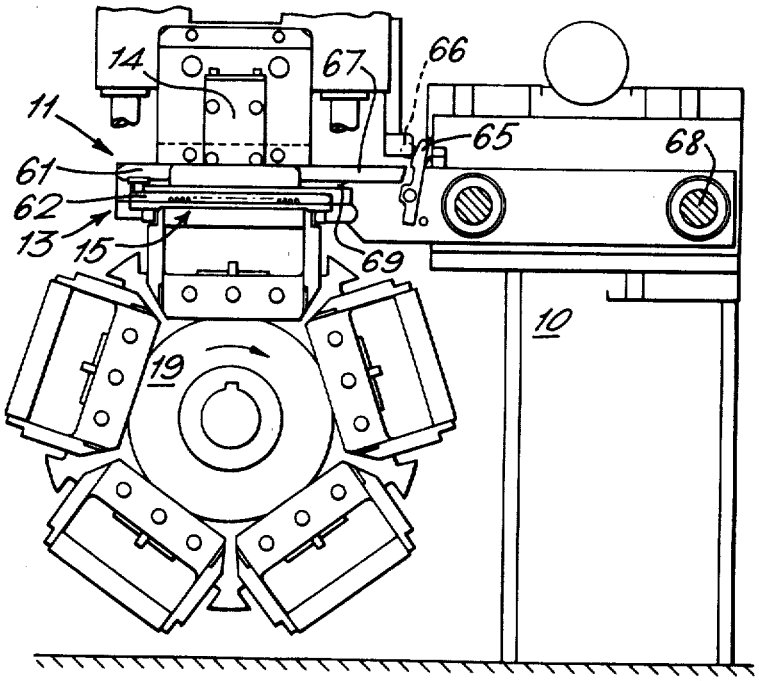
FIG. 4 is a diagrammatic end view of the terminating station.

In operation of the apparatus to terminate a series of wires at one end and to prepare the other ends of the wires for termination or testing, the wire holding head 13 is advanced from behind the second station 12 to the first station 11 with the clamping arms 67 engaging the wires which protrude at leading ends from the guide 62 so that they are generally aligned above respective slotted wire-connecting portions of a connector mounted in the connector holder. The steady arm 25 is then advanced to hold the connector support precisely located. The ram 14 is then depressed to drive the wires into the respective wire-connecting portions. During final stages of movement of the ram the abutment pin 20 engages the guide 62 to depress the guide lowering the leading ends of the wires adjacent the respective wire-connecting portions ensuring that they are accurately driven into the wire-connecting portions. Downward movement of the ram also causes the roller 66 to engage and release the catch 65 permitting the clamping arms 67 to be raised by the spring 69 (FIGS. 1 and 4) releasing the wires.

The wire holding head is then returned along the wires to a location immediately behind the severing and stripping blades and the wire lengthening arm 30 is depressed to draw wires through the wire holding head.

The severing and stripping assembly 36 is then depressed during which movement the abutment depresses the clamping arms on the head to clamp the wires and the abutment pin 35, depresses the guide 62 against a stop 7 on the frame base. During the final stages in the downward movement of the head the severing blades 38, 40 sever the wires and the stripping blades 37, 39 penetrate the insulation on the wires. The roller 45 also engages the wires to clamp them laterally. Further downward movement of the wire lengthening arm 30 pulls the wires to strip insulation from their ends (FIG. 2).

The combs 51 are then raised by advancing rod 56 to push the linkage 53, 55 overcentre to maintain the severed ends of the wires in their predetermined laterally spaced relation (FIG. 3).

Both the ram 11 and the head assembly 36 are then raised, together with the wire lengthening arm 30 and the connector steadying arm 25 and comb operating rod 56 withdrawn.

The turrets 19 and 27 are then indexed to convey the wires terminated at one end and held in predetermined laterally spaced relation by the combs at their other ends to a testing or termination station at the same time bringing another connector into alignment with the ram.

Subsequent rotary indexing of the turrets causes the ejection cam to operate the connector ejection mechanism, ejecting the connector from the holder and the trip arm 58 is thrown to return the linkage 53, 55 to its former position lowering the combs 51.

What is claimed is:

1. Apparatus for terminating individual wires of a series of wire simultaneously in respective contacts arranged in a row in an electrical connector which apparatus comprises a terminating station comprising a connector support and a ram mounted to reciprocate relative to the support to drive wires into wire-receiving parts of respective contacts of the connector when mounted on the support, and a wire holding head mounted to reciprocate between the terminating station and a wire supply to feed a series of wires from the supply to a location spaced from, and between, the connector and the ram, the wire holding head comprising a wire clamp and a wire guide pivotally mounted on the clamp to extend towards the terminating station, and having a series of wire-receiving passageways retaining wires when held in the clamp, in predetermined, laterally spaced, parallel coplanar relation, an abutment being mounted on the ram arranged to engage the wire guide during a terminating stroke to pivot the guide towards the connector support to guide leading ends of the wires to wire connecting parts of respective contacts in the connector.

2. Apparatus according to claim 1, in which the connector support comprises a series of connector holders located on a turret mounted for stepped rotation about an axis parallel to the path of movement of the wire holding head when the wire holding head is remote from the termination station to bring connectors successively into alignment with the ram.

3. Apparatus for terminating individual wires of a series of wires simultaneously in respective contacts arranged in a row in an electrical connector including a terminating station and a wire severing and stripping station spaced from the terminating station, the terminating station comprising a connector support and a ram mounted to reciprocate relative to the support to drive wires into wire-receiving parts of respective contacts of a connector when mounted on the support; a wire holding head mounted to reciprocate passed the severing and stripping station between the terminating station and a wire supply on a side of the severing and stripping station remote from the terminating station to feed a series of wires in predetermined, laterally spaced, parallel coplanar relation to extend through the severing station to the terminating station; a wire support being mounted between the severing and stripping station and the terminating station and comprising a wire location comb, means being provided to move the comb from a position spaced from the wires prior to the said reciprocal movement of the wire holding head into engagement with the wires releasably to maintain their predetermined spacing after severing.

4. Apparatus according to claim 3, in which a series of the said connector supports and the said wire supports are located on respective turrets mounted for synchronous stepped rotation about an axis parallel to the path of movement of the wire holding head after termination and severing.

5. Apparatus for terminating individual wires of a series of wire simultaneously in respective contacts arranged in a row in an electrical connector which apparatus comprises a terminating station comprising a connector support and a ram mounted to reciprocate relative to the support to drive wires into wire-receiving parts of respective contacts of the connector when mounted on the support, and a wire holding head mounted to reciprocate between the terminating station and a wire supply to feed a series of wires from the supply to a location spaced from, and between, the connector and the ram, the wire holding head including a wire clamp having a series of wire-receiving passageways retaining wires when held in the clamp, in predetermined, laterally spaced, parallel coplanar relation, and the connector support comprising a series of connector holders located on a turret mounted for stepped rotation about an axis parallel to the path of movement of the wire holding head when the wire holding head is remote from the termination station to bring connectors successively into alignment with the ram.

* * * * *